United States Patent [19]

Fu

[11] Patent Number: 4,900,012

[45] Date of Patent: Feb. 13, 1990

[54] LEG EXERISING SYSTEM

[76] Inventor: Yeh H. Fu, No. 9, Lane 148, Pu Yi Road, Chung Li, Taiwan

[21] Appl. No.: 282,731

[22] Filed: Dec. 12, 1988

[51] Int. Cl.[4] ..... A63B 32/06; A63B 5/00; A63B 21/02

[52] U.S. Cl. ..... 272/65; 272/70; 272/69; 272/141

[58] Field of Search ..... 272/65, 69, 70, 141, 272/142, 94, 96, 97, 73, 130; 128/25 R, 25 B

[56] References Cited

U.S. PATENT DOCUMENTS

| | | | |
|---|---|---|---|
| 829,754 | 8/1906 | Bailey | 272/142 |
| 3,628,791 | 12/1971 | Garcia | 272/141 |
| 4,645,197 | 2/1987 | McFee | 272/65 |
| 4,708,338 | 11/1987 | Potts | 272/69 |
| 4,775,149 | 10/1988 | Wilson | 272/141 |

*Primary Examiner*—Stephen R. Crow
*Attorney, Agent, or Firm*—Morton J. Rosenberg; David I. Klein

[57] ABSTRACT

This invention relates to a leg exercising system which includes a first pair of tubular members having a pair of handles secured to respective ends thereof. A second pair of tubular members are connected to an upper section of the first pair of tubular members. Additionally, there is included a pair of tubular rods which extend in parallel directions each with respect to the other and are displaced from each other. The pair of tubular rods are mounted between respective tubular members of the second pair of tubular members. A first and second pair of I-shaped sleeve members are slidingly engageable on each of the tubular members and tubular rods. A first and second pair of helical spring members are mounted on each of the tubular members and on each of the tubular rods with all of the helical spring members being sandwiched between a base support member and respective I-shaped sleeve members. A pair of connecting rods are respectively secured on opposing ends to an I-shaped sleeve member with a pair of pedals fixedly secured on each of the pair of connecting rods wherein a user may stand on the pedals and reciprocally displace the pedal members.

1 Claim, 6 Drawing Sheets

LEG EXERISING SYSTEM

BACKGROUND OF THE INVENTION

The importance of a regular exercise regiment is well known for a variety of reasons ranging from controlling weight to general physical fitness as well as a physical therapy for persons recovering from heart ailments.

The type and extent of exercise for individuals often depends on a physician's recommendation however, it is generally recognized that exercise should be done on a regular basis and should further be sufficiently strenuous to allow the user's heart rate to be accelerated for a reasonable time.

For a number of persons, outdoor exercise is preferred with the sport of jogging and walking being very popular. However, weather conditions and other factors may make indoor exercise systems preferable and in various prior art indoor exercising systems there has been used stationary bicycles for treadmill exercisers.

However, such devices are believed by many to be monotonous and a user's interest in the exercise program is often lost over a period of time.

It is therefore an object of the present invention to provide a leg exercising system which may obviate and mitigate the above-mentioned drawbacks.

SUMMARY OF THE INVENTION

The subject invention relates to a leg exercising system which includes a base support member. A first pair of tubular members having a pair of handles secured to respective upper ends of the first pair of tubular members is provided. Additionally, a second pair of tubular members is secured to an upper section of the first pair of tubular members. The second pair of tubular members extends in a parallel direction and are displaced each from the other. A pair of parallel displaced tubular rods are mounted between the second pair of tubular members. A first pair of I-shaped sleeve members are slidingly engageable on each of the second pair of tubular members. A second pair of I-shaped sleeve members are also slidingly engageable on each of the pair of tubular rods. A first pair of helical spring members are mounted on each of the second pair of tubular members between the base support member and respective I-shaped sleeve members. A second pair of helical spring members are mounted on each of the second pair of tubular rods between the base support member and respective I-shaped sleeve members. A pair of connecting rods are secured on opposing ends to an I-shaped sleeve on one of the second pair of tubular members and an I-shaped sleeve on one of the pair of tubular rods. A pair of pedals are secured on each of the connecting rods wherein a user may stand on the pedals and produce a reciprocating displacement.

It is the primary object of the present invention concept to provide a leg exercising system wherein the use of such allows a pleasurable exercise regimen for the user.

It is another object of the subject invention to provide a leg exercising system which may be operated by a wide range of uses of varying strength capabilities.

It is still another object of the subject invention to proivde a leg exercising system which is simple to operate.

It is still another object of the present invention concept to provide a leg exercising system which is safe to use.

It is a still further object of the present invention to produce a leg exercising system which has economic advantages in the manufacturing process.

Other objects and a fuller understanding of the present invention concept will be obtained by those having ordinary skill in the art when the following detailed description of the preferred embodiment contemplated for practising the best mode of the invention has been read in conjunction with the accompanying drawings wherein like numerals refer to like parts.

DETAILED DESCRIPTION OF THE PREFERRED EMBODIMENT

Prior to explaining the present invention concept in detail, it is to be understood that the invention is not limited in its application to the details of construction and arrangement of parts illustrated in the accompanying drawings since the invention concept is capable of other embodiments and of being practiced or carried out in various ways. Additionally, it is to be understood that the phraseology and/or terminology employed herein is for the purpose of description and not of limitation.

Figure 1:
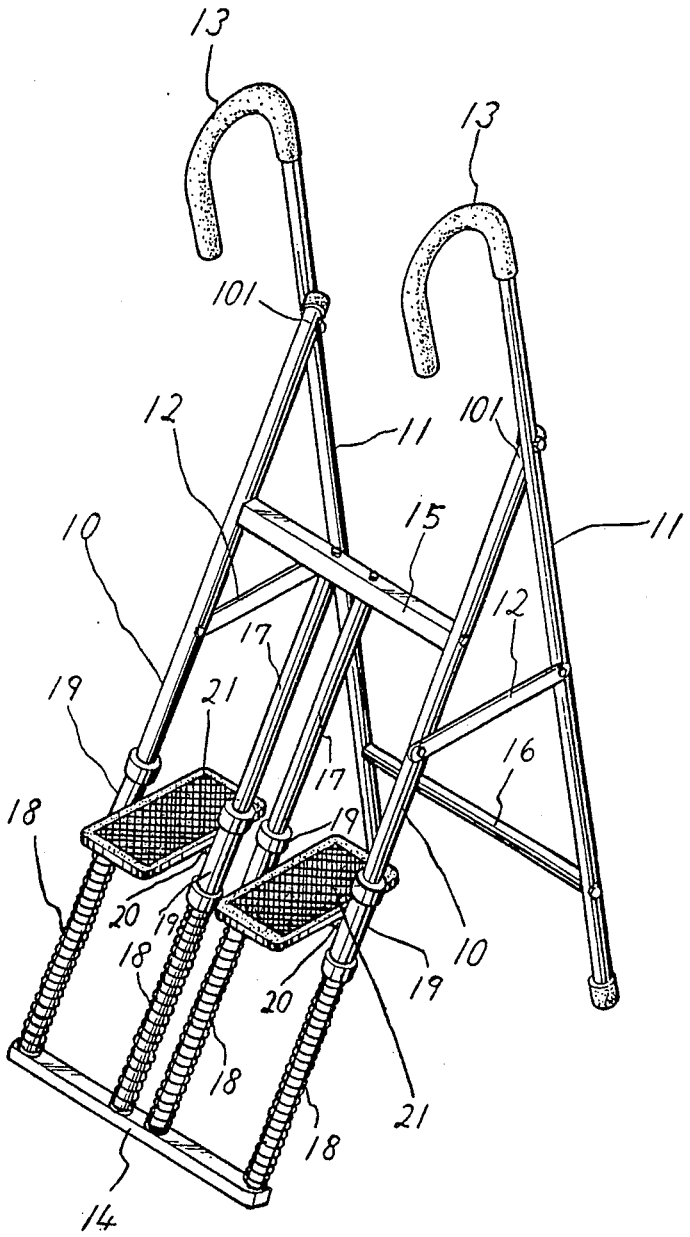
FIG. 1 is a perspective view of the leg exercising system according to the present invention concept.
Figure 2:
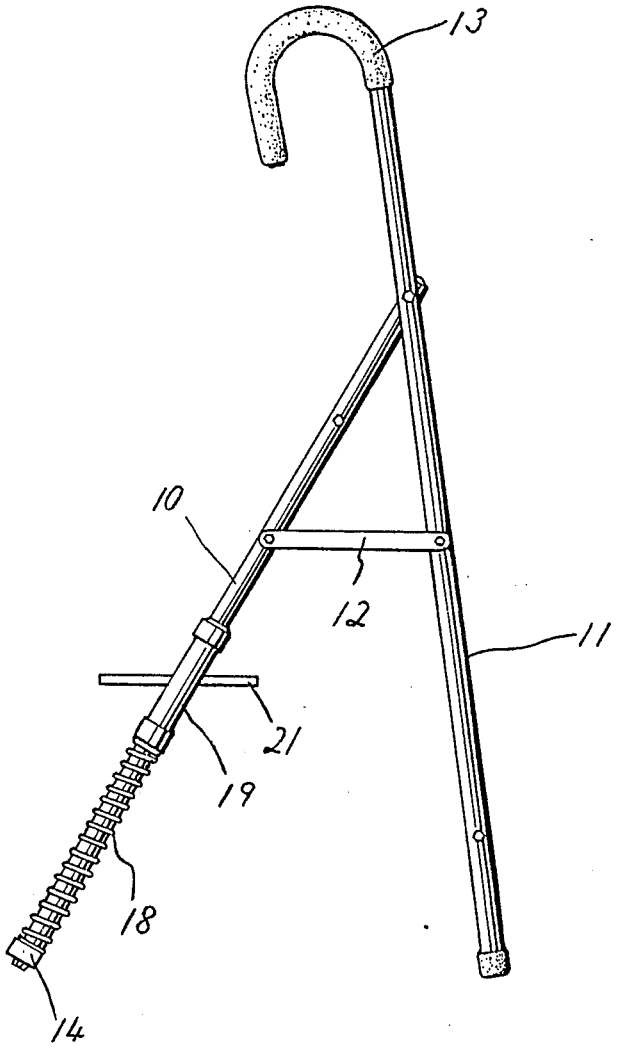
FIG. 2 is a side elevational view of the leg exercising system of the instant invention concept.

Referring now to FIG. 1, there is shown the leg exercising system according to the present invention which includes a second pair of tubular members 10 and a first pair of tubular members 11. As can be seen in FIGS. 1, 3, 4 and 6, each of the first pair of tubular members 11 extends substantially parallel to each other however, such are displaced in a transverse direction. Additionally, each of the second pair of tubular members 10 similarly extend in a parallel direction each with respect to the other and are also displaced each from the other in the transverse direction.

Cross-rod 12 is mounted between each of the tubular members 10 and 11 and is mounted respective to the tubular members 10 and 11 on opposing ends thereof for separating the tubular members at a fixed inclined positional displacement.

An upper end 101 of each of the second pair of tubular members 10 is rigidly connected with an upper section of a respective tubular member 11 located below a handle 13.

A base support 14 is mounted between the lower ends of each of the second pair of tubular members 10 while a bar 15 extending in a transverse direction is fixedly connected on opposing ends between upper portions of each of the second pair of tubular members 10. A cross-rod 16 is mounted between each of the first pair of tubular members 11 and the lower section thereof.

Mounted between the second pair of tubular members 10 are a pair of tubular rods 17 which extend parallel each with respect to the other and with respect to each of the tubular members of the second pair of tubular members 10. Each of the tubular rods 17 are fixedly mounted on opposing ends thereof to base support member 14 and transversely extending bar member 15. Thus, the pair of tubular rods 17 lie in substantially the same plane as the second pair of tubular members 10 as is clearly seen in FIGS. 1–7. Each of the second pair of tubular members 10 and the tubular rods 17 are enclosed by respective helical springs 18 mounted on lower portions thereof and contiguous the base support member 14.

Figure 3:
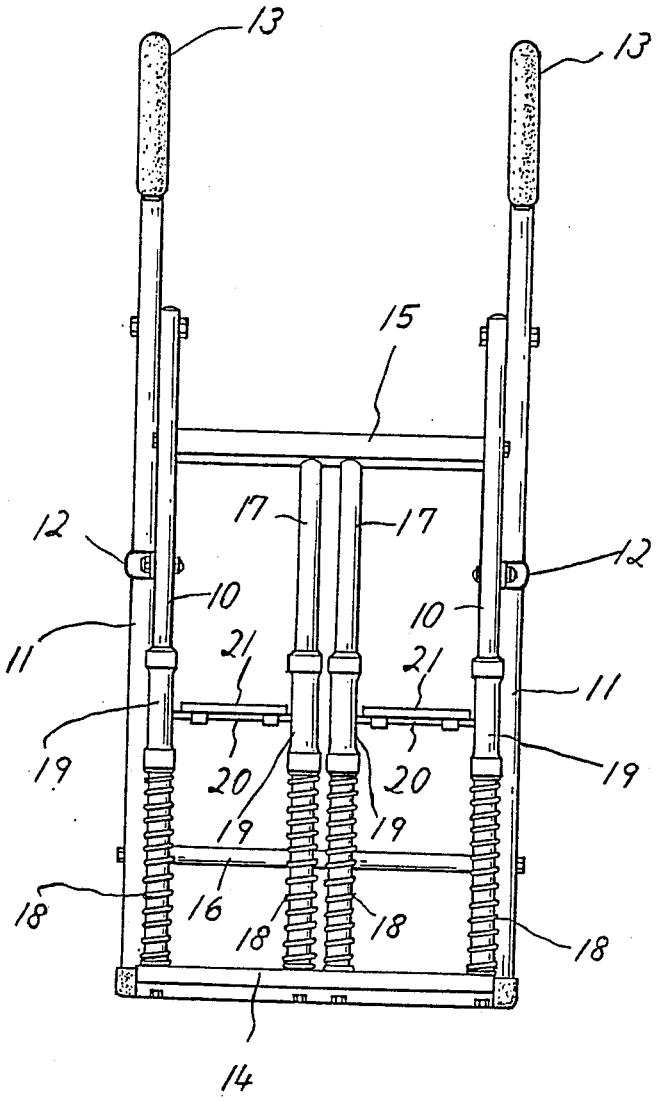
FIG. 3 is a front elevational view of the leg exercising system of the subject invention concept.
Figure 4:
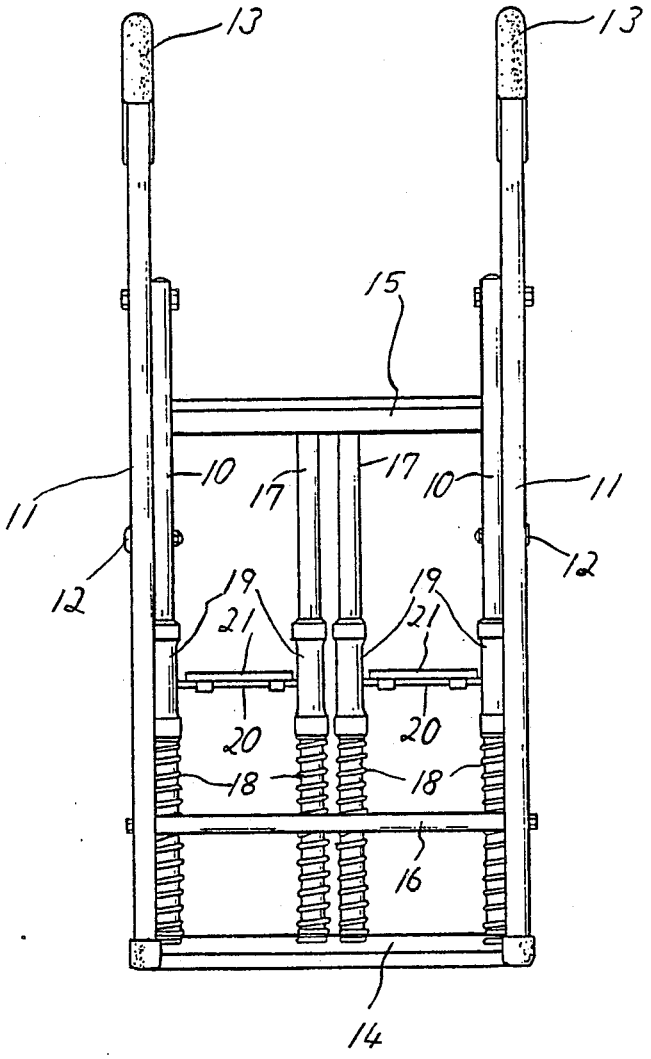
FIG. 4 is a rear elevational view of the leg exercising system of the instant invention concept.
Figure 5:
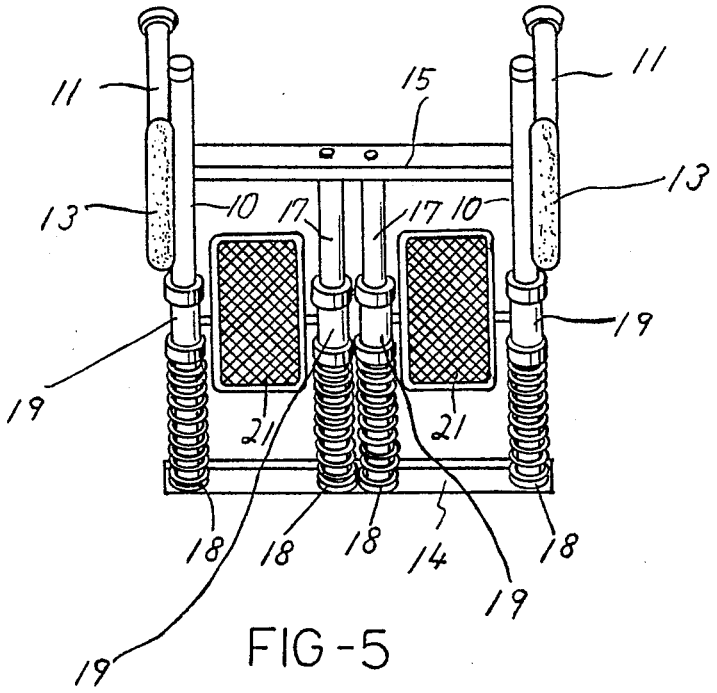
FIG. 5 is a plan view of the leg exercising system.
Figure 6:
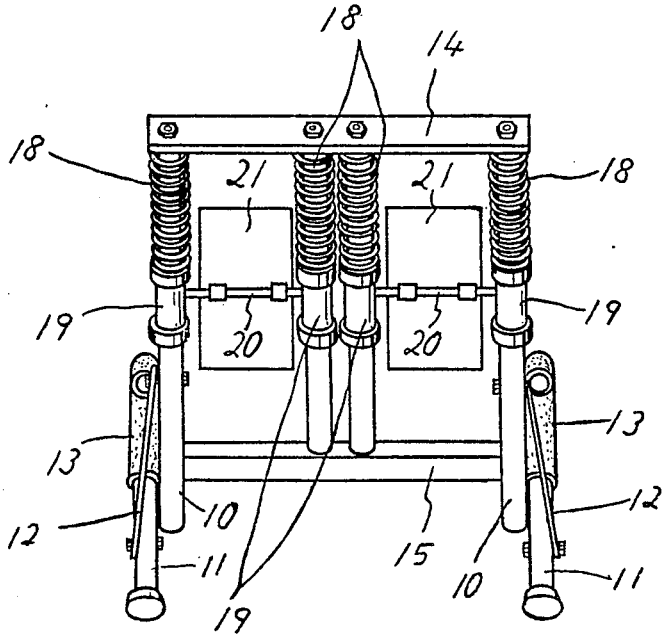
FIG. 6 is a bottom plan view of the leg exercising system.

Two pairs of I-shaped sleeve members 19 slidingly engage on each of the second pair of tubular members 10 and each of the tubular rods 17. A connecting rod 20 clearly seen in FIGS. 3, 4 and 6 is fixedly secured by welding or some like technique between a pair of I-shaped sleeves 19 on respective ones of second pair of tubular members 10 and rods 17. On each connecting rod 20 there is fixedly secured a pedal member 21.

Figure 7:
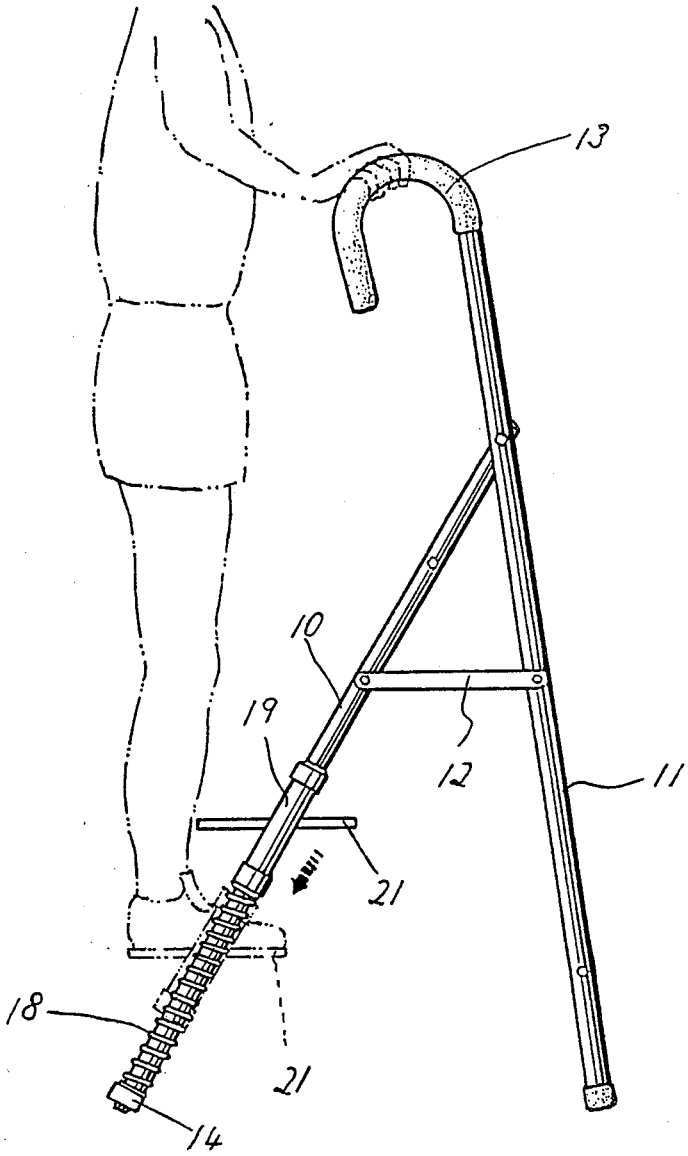
FIG. 7 is a side elevational view of the leg exercising system when in use.

In operation, a user steps on the pedals 21 and grips the handles 13 as is shown in FIG. 7. By reciprocating the pedals 21 with the user's feet in an alternate fashion, utilizing the biasing force of the springs 18, the pedal members 21 will move downward and upward in a reciprocating manner to provide a leg exercise similar to that of the user walking up a slope or walking up stairs. Additionally, it is also possible to displace the pedals simultaneously in order to exercise the arms, and feet in varying manners.

Other embodiments and modifications will occur to those skilled in the art. No attempt has been made to illustrate all possible embodiments of the invention, but rather such intended alterations and alternatives as well as further applications as illustrated herein are contemplated as would normally occur to one skilled in the art to which the invention relates.

I claim:

1. A leg exercising system comprising:

a base support member;

a first pair of tubular members having a pair of handles secured to respective upper ends of said first pair of said tubular members;

a second pair of tubular members secured to an upper section of said first pair of tubular members, said second pair of tubular members extending in a parallel direction and displaced each from the other;

a pair of parallel displaced tubular rods mounted between said second pair of tubular members;

a first pair of I-shaped sleeve members slidingly engageable respectively on each of said second pair of tubular members;

a second pair of I-shaped sleeve members slidingly engageable respectively on each of said pair of tubular rods;

a first pair of helical spring members respectively mounted on each of said second pair of tubular members between said base support member and respective I-shaped sleeve members;

a second pair of helical spring members respectively mounted on each of said second pair of tubular rods between said base support member and respective I-shaped sleeve members;

a pair of connecting rods respectively secured on opposing ends to an I-shaped sleeve on one of said second pair of tubular members and and I-shaped sleeve on one of said pair of tubular rods; and a pair of pedals fixedly secured on each of said pair of connecting rods respectively, whereby a user may stand on said pedals and produce a reciprocating displacement.

* * * * *